US011525385B2

(12) United States Patent
Chen et al.

(10) Patent No.: US 11,525,385 B2
(45) Date of Patent: Dec. 13, 2022

(54) DIVERTER FITTINGS FOR COOLING SYSTEMS OF AN ENGINE

(71) Applicant: Caterpillar Inc., Peoria, IL (US)

(72) Inventors: Allen Yao Chen, Dunlap, IL (US); Aaron Gary Heintz, Washington, IL (US); Jason Lee Van Farowe, Brimfield, IL (US); Thomas L. Atwell, Peoria, IL (US); Scott R. Schuricht, Princeville, IL (US); Lance Clay Barke, Dunlap, IL (US); Phani Chandar Reddy Konatham, Peoria, IL (US); Vijaya Krishna Dara, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 192 days.

(21) Appl. No.: 16/789,844

(22) Filed: Feb. 13, 2020

(65) Prior Publication Data

US 2021/0254539 A1 Aug. 19, 2021

(51) Int. Cl.

| | |
|---|---|
| ***F01P 7/14*** | (2006.01) |
| ***F01P 7/16*** | (2006.01) |
| ***F01P 5/10*** | (2006.01) |
| *F01M 5/00* | (2006.01) |
| *F01P 3/02* | (2006.01) |

(52) U.S. Cl.

CPC ..... *F01P 7/16* (2013.01); *F01P 5/10* (2013.01); *F01M 2005/004* (2013.01);
(Continued)

(58) Field of Classification Search

CPC ..... F01P 7/16; F01P 5/10; F01P 3/02; F01P 2007/146; F01P 2031/32; F01P 2060/045; F01M 2005/004
(Continued)

(56) References Cited

U.S. PATENT DOCUMENTS

| | | | |
|---|---|---|---|
| 7,343,882 | B2 | 3/2008 | Pipkorn et al. |
| 8,376,029 | B2 | 2/2013 | Rericha et al. |

(Continued)

FOREIGN PATENT DOCUMENTS

| | | | |
|---|---|---|---|
| CN | 100376875 | C | 3/2008 |
| CN | 204041199 | U | 12/2014 |

(Continued)

*Primary Examiner* — Hung Q Nguyen
*Assistant Examiner* — Anthony Donald Taylor, Jr.
(74) *Attorney, Agent, or Firm* — Bookoff McAndrews, PLLC

(57) ABSTRACT

A passive diverter fitting for a cooling system of an engine includes a base defining an interior cavity, an inlet opening extending through the base that is in fluid communication with the interior cavity, an outlet opening that is in fluid communication with the interior cavity, and a bypass opening that is in fluid communication with the interior cavity. The base is configured to be removably disposed in a cavity of an engine block. The inlet opening is positioned to receive coolant when the passive diverter fitting is disposed in the cavity of the engine block. The outlet opening is in fluid communication with the area exterior to the engine block when the passive diverter fitting is disposed in the cavity of the engine block. The bypass opening is in fluid communication with an interior coolant passage of the engine block when the passive diverter fitting is disposed in the cavity of the engine block.

20 Claims, 5 Drawing Sheets

(52) U.S. Cl.
CPC ..... *F01P 3/02* (2013.01); *F01P 2007/146* (2013.01); *F01P 2031/32* (2013.01); *F01P 2060/045* (2013.01)

(58) Field of Classification Search
USPC ..... 123/41.1
See application file for complete search history.

(56) References Cited

U.S. PATENT DOCUMENTS

| | | | | |
|---|---|---|---|---|
| 8,443,765 | B2 | 5/2013 | Hollis | |
| 2002/0148416 | A1 * | 10/2002 | Cohen | F01P 7/16 123/41.1 |
| 2005/0028756 | A1 * | 2/2005 | Santanam | F01P 7/165 123/41.1 |
| 2006/0032844 | A1 * | 2/2006 | Kingrey | F01P 11/20 219/208 |

FOREIGN PATENT DOCUMENTS

| | | | | |
|---|---|---|---|---|
| DE | 10127711 | B4 | 2/2007 | |
| DE | 102018122702 | | 3/2020 | |
| FR | WO2018033669 | A1 * | 2/2018 | F01P 11/04 |
| GB | 1279132 | | 6/1972 | |
| IN | 201917006369 | A | 3/2019 | |
| WO | 9603574 | | 2/1996 | |
| WO | 9629509 | | 9/1996 | |
| WO | 2015168313 | | 11/2015 | |
| WO | 2018033669 | | 2/2018 | |

* cited by examiner

DIVERTER FITTINGS FOR COOLING SYSTEMS OF AN ENGINE

STATEMENT OF GOVERNMENT INTEREST

This invention was made with government support under contract DE-EE0008476 awarded by the DOE. The Government has certain rights in this invention.

TECHNICAL FIELD

The present disclosure relates generally to a cooling system for an engine, and more particularly relates to a cooling system that utilizes a passive diverter fitting to divert fluid within the cooling system.

BACKGROUND

Internal combustion engines used to operate motor vehicles or heavy mechanical equipment generate considerable heat that must be dissipated. If not properly dissipated, heat reduces operating efficiency of the engine and can ultimately lead to damage of the engine. Engines typically include a cooling system that is configured to circulate coolant through the engine block such that the coolant captures the heat from the engine to cool the engine. The coolant then moves through a radiator such that the coolant loses the heat to the atmosphere before moving back through the engine block.

In some instances, the engine cooling system can be used to provide auxiliary cooling to coolers for engine accessories (e.g., transmission coolers, brake coolers, etc.). For example, conventional transmission coolers and/or brake coolers often use the engine's coolant to cool the hydraulic fluid used with the transmission and/or brake coolers. These coolers for engine accessories typically take the form of a shell and tube heat exchanger, which means that these coolers are typically too large to fit on the engine and must be located elsewhere in the machine chassis.

German Patent No. DE10127711 ("the '711 patent") discloses a three-way valve that can be used as a replacement to a thermostatic valve in a cooling system for an engine. The three-way valve is used to control the mixing ratio between a supply line to a radiator and a bypass line that bypasses the radiator. The three-way valve includes a throttle body that is actively controlled to control the diversion of coolant flow to the radiator and the bypass line.

SUMMARY

An exemplary coolant diverter fitting includes a base defining an interior cavity, an inlet opening extending through the base that is in fluid communication with the interior cavity, an outlet opening that is in fluid communication with the interior cavity, and a bypass opening that is in fluid communication with the interior cavity. The base is configured to be removably disposed in a cavity of an engine block. The inlet opening is in fluid communication with an area exterior to the engine block when the diverter fitting is disposed in the cavity of the engine block. The outlet opening is in fluid communication with the area exterior to the engine block when the diverter fitting is disposed in the cavity of the engine block. The bypass opening is in fluid communication with an interior coolant passage of the engine block when the diverter fitting is disposed in the cavity of the engine block.

An exemplary embodiment of an internal combustion engine includes an engine block defining a block interior coolant passage, a cavity disposed in the engine block, and a diverter fitting disposed in the cavity. The cavity includes a receiving opening for receiving coolant, an inner opening that is in fluid communication with the block interior coolant passage, and an outer opening that is in fluid communication with an area exterior to the engine block. The diverter fitting includes a base defining an interior cavity, an inlet opening, an outlet opening, and a bypass opening. The inlet opening is in fluid communication with the receiving opening of the cavity. The outlet opening is in fluid communication with the outer opening of the cavity. The bypass opening is in fluid communication with the inner opening of the cavity.

An exemplary cooling system includes a pump, an engine having an engine block, a diverter fitting, and a radiator. The pump is configured to pump coolant through the cooling system. The engine block includes a block interior coolant passage, a cavity, and a return opening. The cavity is in fluid communication with the block interior coolant passage and an area exterior to the housing, and the return opening is in fluid communication with the block interior coolant passage and the area exterior to the housing. The diverter fitting includes a base defining an interior cavity, an inlet opening, an outlet opening, and a bypass opening. The inlet opening is in fluid communication with the pump. The outlet opening is in fluid communication with the inlet opening, and the bypass opening is in fluid communication with the inlet opening of the diverter fitting and the block interior coolant passage of the engine block. The external cooler has an inlet passage in fluid communication with the outlet opening of the diverter fitting and an outlet passage in fluid communication with the return opening of the engine block. The radiator is in fluid communication with the engine block and the pump. The pump is configured to pump coolant through the diverter fitting such that a first portion of the coolant moves through the outlet opening of the diverter fitting and into the external cooler and a second portion of the coolant moves through the bypass opening of the diverter fitting and into the block interior coolant passage of the engine block.

DETAILED DESCRIPTION

The Detailed Description describes exemplary embodiments of the invention and is not intended to limit the scope of the claims in any way. Indeed, the invention is broader than and unlimited by the exemplary embodiments, and the terms used in the claims have their full ordinary meaning. Features and components of one exemplary embodiment may be incorporated into the other exemplary embodiments. Inventions within the scope of this application may include additional features, or may have less features, than those shown in the exemplary embodiments.

The present application discloses diverter fittings used for diverting fluid within a cooling system of an engine. While the diverter fitting described herein is described as being used with an engine, it should be understood that the diverter fitting can be used with any other suitable type of cooling system or any other type of system in which fluid is to be diverted.

Figure 1:
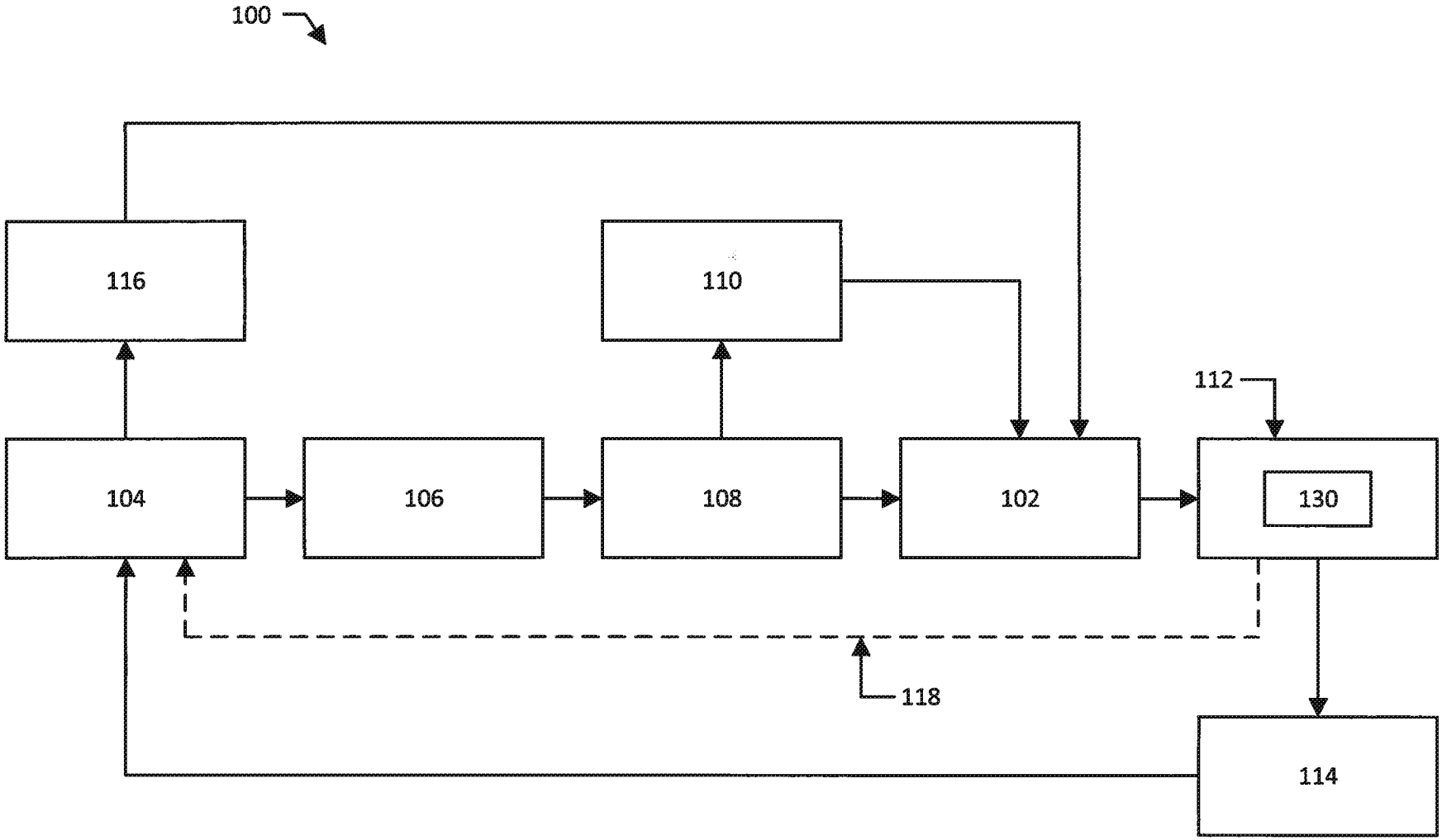
FIG. 1 is a schematic view of an exemplary embodiment of a cooling system for an engine.

FIG. 1 illustrates an exemplary embodiment of a cooling system 100 for an engine 102 (e.g., an internal combustion engine). The cooling system includes a pump 104, a diverter fitting 108, an external cooler 110, and a radiator 114. The pump 104 is configured to pump coolant (e.g., water, a mixture that includes water, oil, a mixture that includes oil, or any other suitable type of coolant) through the cooling system 100 to cool down the engine 102, as well as cool down fluid moving through the external cooler 110. The pump 104 can be, for example, a centrifugal pump, or any other suitable type of pump for an engine. The external cooler 110 can be, for example, a transmission cooler, a brake cooler, or any other suitable type of external cooler that receives auxiliary cooling from the cooling system 100 of the engine 102. In addition, the external cooler 110 can take any suitable form, such as, for example, the form of a 4-port style cooler, a shell and tube style cooler, a bathtub 2-port style cooler, or any other suitable type of cooler.

Figure 2:
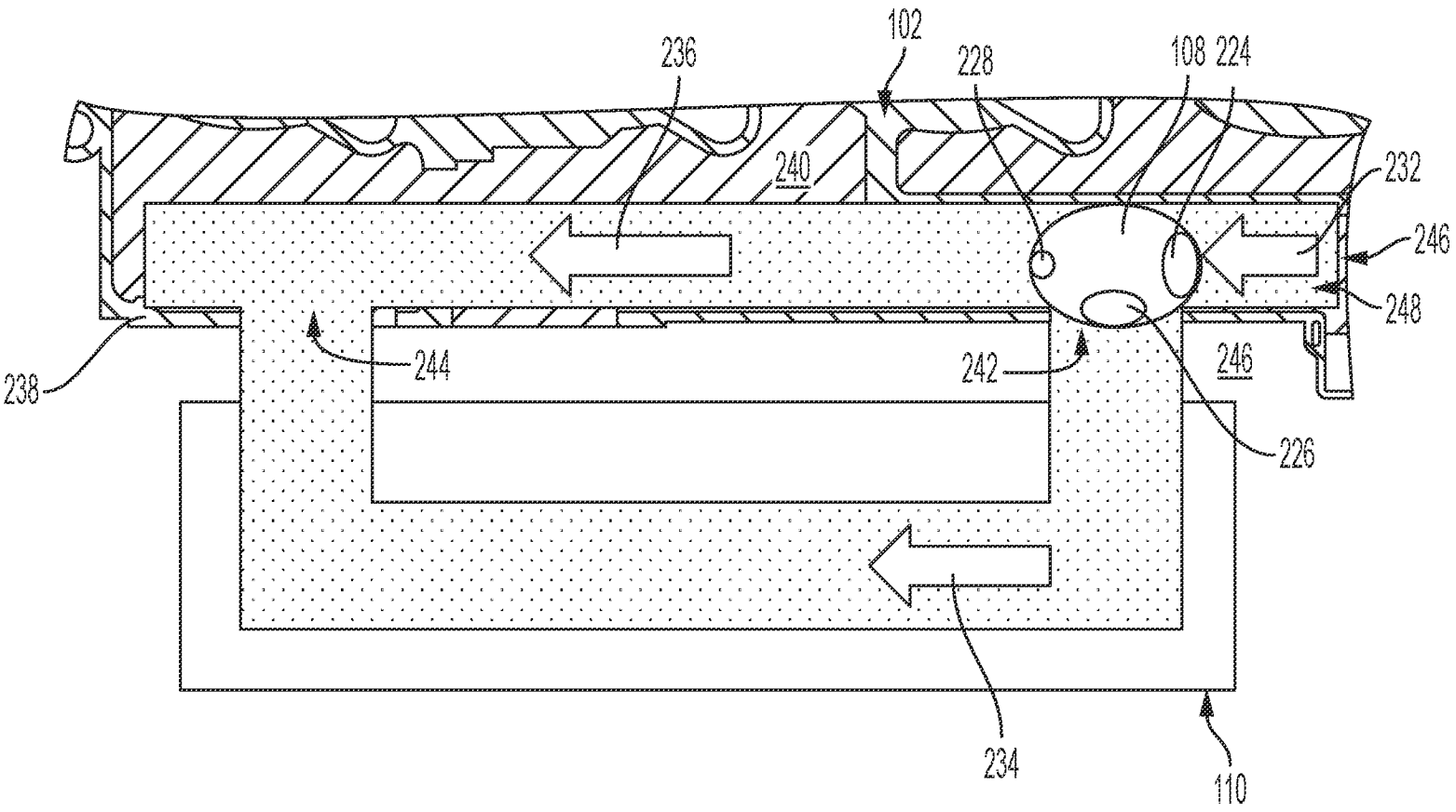
FIG. 2 is a partial top schematic view of the cooling system of FIG. 1, in which coolant is shown moving through a diverter fitting and into an engine block and an external cooler.

Referring to FIGS. 1 and 2, in certain embodiments, the external cooler 110 is connected to an engine block 238 (FIG. 2) of the engine 102 such that the external cooler 110 is in fluid communication with a cavity 242 (FIG. 2) of the engine block 238 and a return opening 244 of the engine block 238. The cavity 242 and the return opening 244 are each in fluid communication with both an interior coolant passage 240 (FIG. 2) of the engine block 238 and an exterior 246 (FIG. 2) of the engine block 238. The interior coolant passage 240 can be, for example, an entry rail, inlet rail, cylinder head water jacket, or any other coolant passage within the interior of the engine block.

In the illustrated embodiment, the diverter fitting 108 includes an inlet opening 224 (FIG. 2), an outlet opening 226 (FIG. 2), and a bypass opening 228 (FIG. 2). The inlet opening 224 is configured to be positioned to receive coolant when the diverter fitting 108 is disposed in the cavity 242 of the engine block. For example, the inlet opening 224 may be in fluid communication with a coolant passage 248 (FIG. 2) that is positioned on the exterior surface of the engine block 238 and in fluid communication with the pump 104. In other embodiments, the coolant passage 248 may be disposed in an interior of the engine block 238, and the coolant passage 248 is in fluid communication with the exterior 246 of the engine block.

In addition, the diverter fitting 108 is positioned in the cavity 242 such that the outlet opening 226 is in fluid communication with the exterior 246 of the engine block 238 (and the external cooler 110 when the external cooler 110 is attached to the engine block 238), and such that the bypass opening 228 is in fluid communication with the interior coolant passage 240 of the engine block 238. In certain embodiments, the diverter fitting 108 is a modular component that is able to be inserted into and removed from the engine 102.

When the diverter fitting 108 is positioned in the cavity 242, coolant 232 pumped by the pump 104 through the passage 248 moves into the inlet opening 224 of the diverter fitting 108 and is split such that a first portion 234 (FIG. 2) of the coolant 232 moves through the outlet opening 226 and enters the external cooler 110, and a second portion 236 (FIG. 2) of the coolant 232 moves through the bypass opening 228 and enters the interior coolant passage 240 of the engine block 238. The first portion 234 of the coolant 232 re-enters the interior coolant passage 240 of the engine block 238 through the return opening 244 after moving through the external cooler 110 such that the first portion 234 and the second portion 236 of the coolant 232 mix in the interior coolant passage 240 of the engine block 238 at a position adjacent to wherein the first portion 234 the interior coolant passage 240 enters the engine block 238. The diverter fitting 108 is configured to limit the amount of coolant that moves into the external cooler 110.

Referring again to FIG. 1, after the coolant moves through the external cooler 110 and the engine 102, the coolant may move into the radiator 114. The coolant entering the radiator 114 may become heated as a result of moving through the external cooler 110 and the engine 102. The radiator 114 is configured to cool the coolant by transferring heat from the coolant to the surrounding atmosphere. The radiator 114 may take any suitable form, such as, for example any form of a heat exchange that is capable of transferring heat from the coolant to the atmosphere. After the coolant moves through the radiator 114, the cooled coolant moves back through the pump 104 such that the pump 104 can again pump the coolant through the cooling system 100.

In certain embodiments, the cooling system 100 includes an oil cooler 106 disposed between the pump 104 and the engine 102. In these embodiments, the pump 104 may first pump coolant through the oil cooler 106 such that the coolant cools oil that is used for lubricating components of the engine 102. The oil cooler 106 may be attached to an exterior of the engine block 238 (FIG. 2) of the engine 102, or the oil cooler 106 may be separated from the engine 102 while remaining in fluid communication with the engine 102.

In some embodiments, the cooling system 100 includes a thermostat housing 112 disposed between and in fluid communication with the engine 102 and the radiator 114. After the coolant moves through the engine 102, the coolant enters the thermostat housing 112. The thermostat housing 112 houses a thermostat 130 that is configured to regulate the temperature of the coolant. If the coolant is below a predetermined temperature, the thermostat 130 maintains a normally-closed position such that the coolant moves through a bypass line 118 (rather than moving into the radiator 114) and into the pump 104. If the coolant is above a predetermined temperature, the thermostat 130 moves to an open position such that the coolant moves into the radiator 114.

In some embodiments, the pump 104 pumps a portion of the coolant to an aftercooler 116. Coolant moving through the aftercooler 116 cools compressed air leaving a turbocharger compressor (not shown) prior to the air entering the engine 102. In certain embodiments, as shown in FIG. 1, the coolant moves into the engine 102 after exiting the aftercooler 116 such that the coolant mixes with the coolant that entered the engine through the diverter fitting 108 and the external cooler 110. In other embodiments, the coolant from the aftercooler 116 moves into the thermostat housing 112 after exiting the aftercooler 116 such that the coolant mixes with the coolant from the engine 102 in the thermostat housing 112. In each of the embodiments mentioned above, the mixed coolant exits the thermostat housing 112 and moves into either the bypass line 118 or the radiator 114 depending on whether the thermostat 130 is in the open or closed position.

Figure 3:
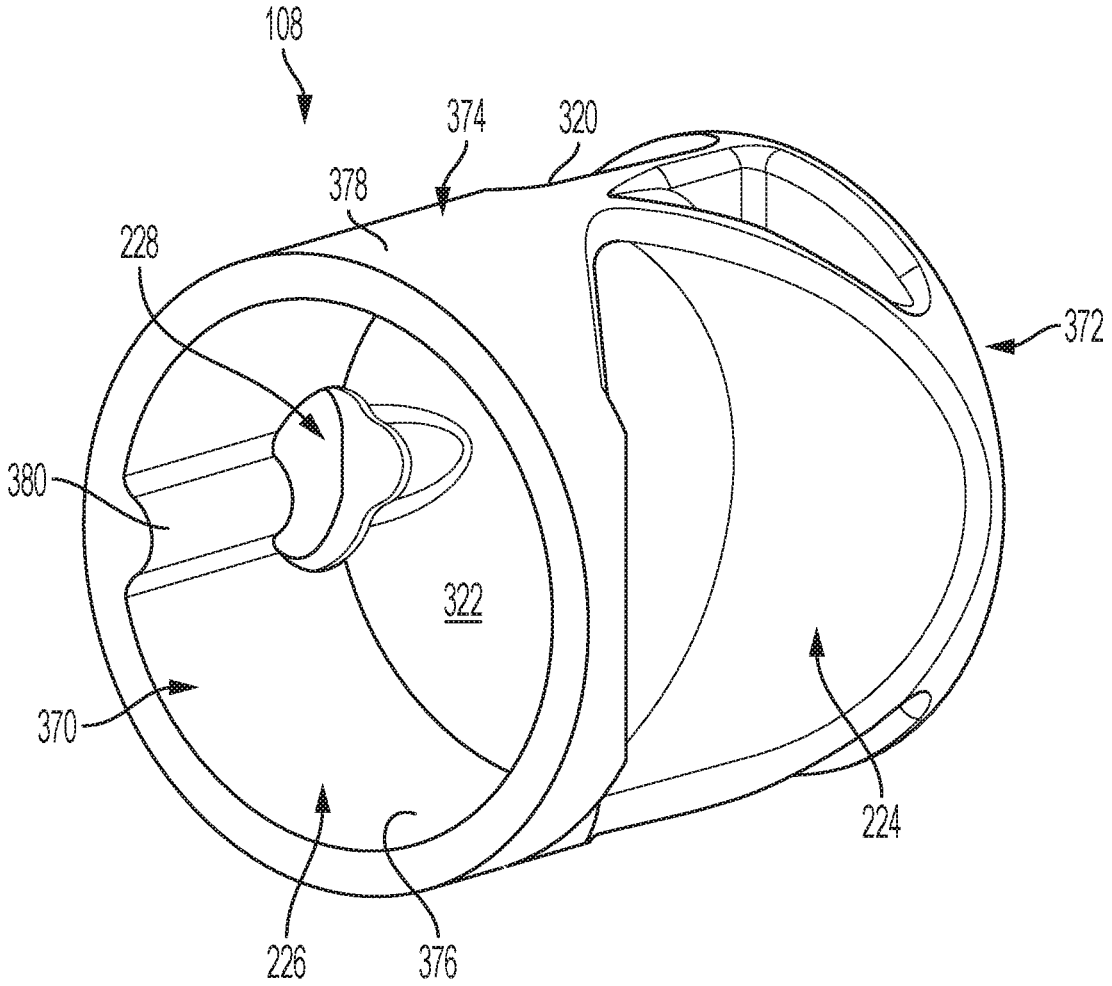
FIG. 3 is a perspective view of an exemplary embodiment of a diverter fitting for the cooling system of FIG. 1.

Referring to FIG. 3, an exemplary embodiment of a passive diverter fitting 108 includes a base 320 defining an interior cavity 322, the inlet opening 224, the outlet opening 226, and the bypass opening 228. The base 320 can be made of, for example, iron, plastic, or any other suitable material. In certain embodiments, the diverter fitting 108 is made by a casting process or an injection molding process, including the inlet opening 224, the outlet opening 226, and the bypass opening 228. In some embodiments, the bypass opening 228 is not made by the same process used to manufacture the other portions of the diverter fitting 108, but the bypass opening 228 is made after the remaining portions of the diverter fitting are manufactured. For example, the bypass opening 228 can be made by drilling a hole through the base 320 of the diverter fitting 108.

In the illustrated embodiment, the base 320 includes a cylindrical side wall 374, an open first end 370 and a closed second end 372. The outlet opening 226 is defined by the open first end 370 of the base 320. The cylindrical side wall 374 includes an inner surface 376 and an outer surface 378, in which the inner surface 376 defines the interior cavity 322. The inlet opening 224 extends through the cylindrical side wall 374 such that the inlet opening 224 is in fluid communication with the interior cavity 322. The inlet opening 224 may be positioned on the base 320 such that an axis extending through the inlet opening 224 is perpendicular to an axis that extends through the outlet opening 226. The bypass opening 228 extends through the cylindrical side wall 374 such that the bypass opening 228 is in fluid communication with the interior cavity 322. The bypass opening 228 may be positioned on the base 320 such that an axis extending through the inlet opening 228 is perpendicular to an axis that extends through the outlet opening 226. In certain embodiments, the inlet opening 224 is positioned on the base substantially opposite the position of the bypass opening 228 (e.g., between about 150 degrees and about 210 degrees about the cylindrical side wall 374 of the base 320, such as about 180 degrees). Although the base 320 is described as having a cylindrical shape, it should be understood that the base 320 can take any suitable form that is capable of being positioned in the cavity 242 of the engine block.

In certain embodiments, such as the illustrated embodiment, the diverter fitting 108 includes a protrusion or rib 380 that extends from the inner surface 376 of the base 320. The rib 380 is configured to strengthen the base 320 to prevent failure of the diverter fitting 108. For example, coolant entering the interior cavity 322 of the base 320 through the inlet opening 224 may engage the inner surface 376 of the base 320 prior to moving through either the outlet opening 226 or the bypass opening 228, and the pressure exerted on the inner surface 376 by the coolant may cause the diverter fitting 108 to wear over time. The rib 380 is configured to provide stiffness to the base 320 to strengthen the base and prevent failure of the diverter fitting 108 due to this wear. In some embodiments, the rib 380 is positioned on the inner surface 376 substantially opposite to the inlet opening 224 (e.g., between about 150 degrees and about 210 degrees about the cylindrical side wall 374 of the base 320, such as about 180 degrees). The rib 380 may, however, be positioned at any location on the base 320 that allows the diverter fitting to strengthen and prevent failure of the diverter fitting.

The inlet opening 224, the outlet opening 226, and the bypass opening 228 may have any suitable size and shape based on the intended use of the diverter fitting 108. That is, these openings 224, 226, 228 may have any size and shape with any suitable cross-sectional areas that allows for adequate cooling of the external cooler 110. In the illustrated embodiment, the outlet opening 226 and the bypass opening 228 have a circular shape. In certain embodiments, an area defined by the bypass opening 228 is less than an area defined by the outlet opening 226. For example, the area defined by the bypass opening 228 may be between about 5% and about 25% of the size of the area defined by the outlet opening 226.

Figure 4:
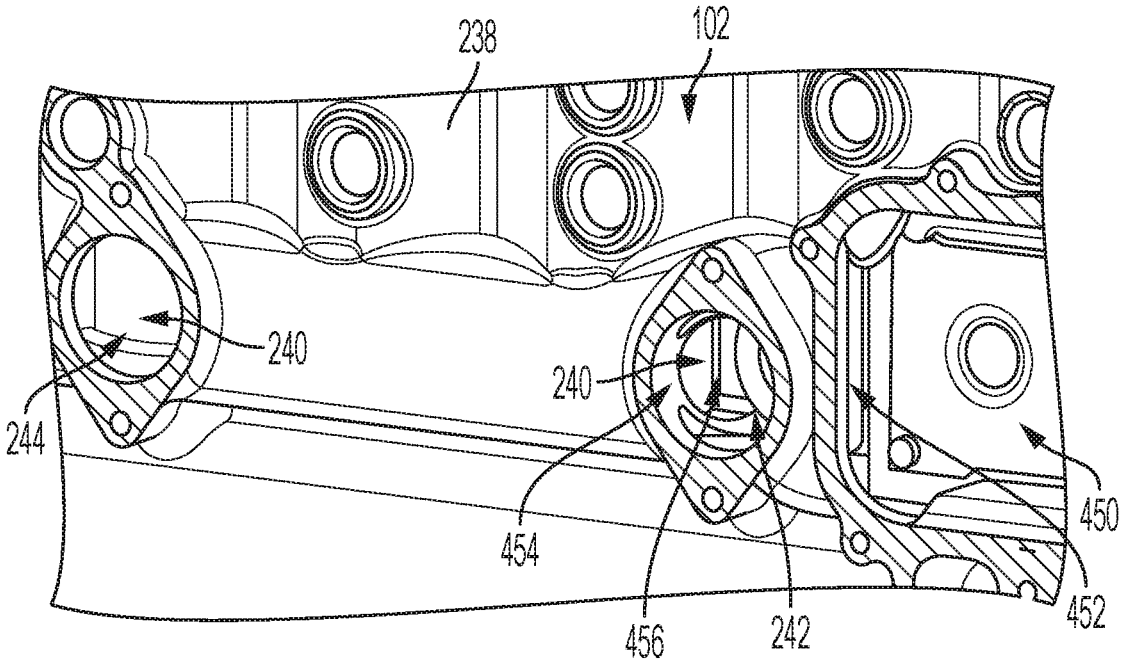
FIG. 4 is a partial perspective view of an exemplary embodiment of an engine block for the cooling system of FIG. 1.
Figure 5:
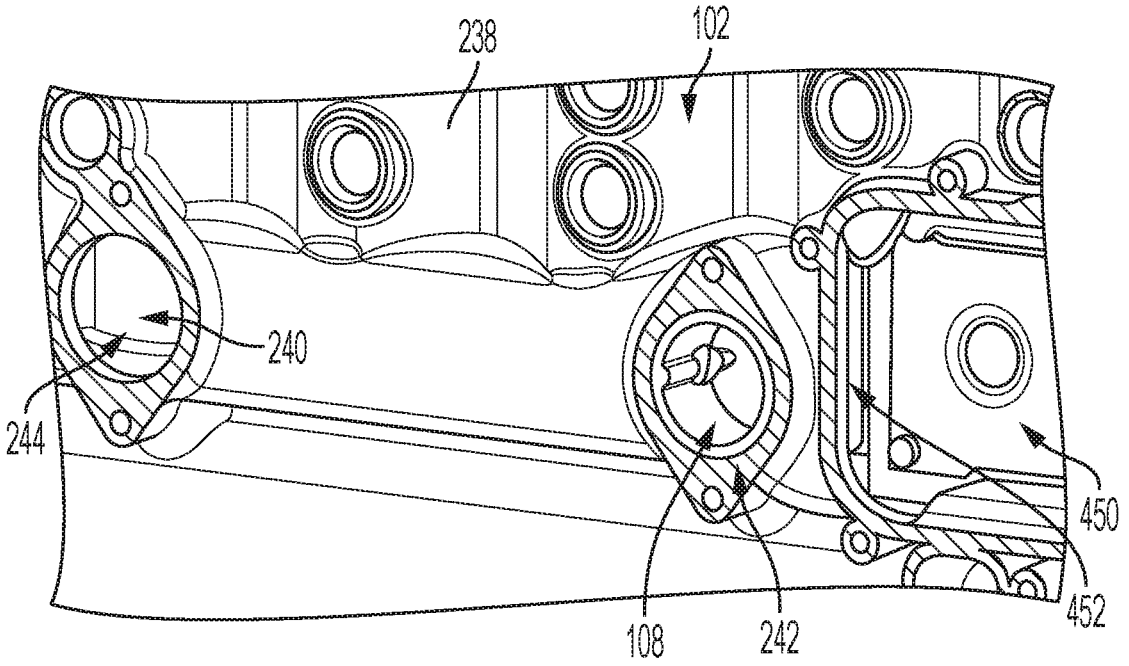
FIG. 5 is a partial perspective view of the diverter fitting of FIG. 3 disposed in the engine block of FIG. 4.

Referring to FIGS. 3-6, the diverter fitting 108 is configured to be disposed in a cavity 242 of an engine block 238 such that the diverter fitting 108 is positioned to receive coolant from a pump (e.g., pump 104 shown in FIG. 1). Referring to FIGS. 4 and 5, in the illustrated embodiment, the engine block 238 includes an oil cooler cavity 450 disposed on its exterior surface, in which the oil cooler cavity 450 is configured to receive an oil cooler (e.g., oil cooler 106 shown in FIG. 1). The cavity 242 includes a receiving opening 452 that is in fluid communication with the oil cooler cavity 450 such that the oil cooler is in fluid communication with the cavity 242. The diverter fitting 108 can be positioned in the cavity 242 such that the inlet opening 224 is in fluid communication with the receiving opening 452 and, consequently, in fluid communication with the oil cooler 106.

Referring again to FIGS. 3-6, when the diverter fitting 108 is positioned in the cavity 242 of the engine block 238, the outlet opening 226 of the diverter fitting 108 is in fluid communication with an outer opening 454 (FIG. 4) of the cavity 242. A portion of the coolant (e.g., the portion 234 of coolant 232 shown in FIG. 2) that is pumped through the inlet opening 224 and into the interior cavity 322 of the diverter fitting 108 moves through the outlet opening 226 of the diverter fitting and through the outer opening 454 of the cavity 242.

Referring to FIG. 4, the cavity 242 includes an inner opening 456 that is in fluid communication with the interior coolant passage 240 of the engine block 238. Referring to FIGS. 3-5, when the diverter fitting 108 is positioned within the cavity 242 of the engine block 238, the bypass opening 228 is in fluid communication with the inner opening 456 of the cavity 242. A portion of the coolant (e.g., the portion 236 of coolant 232 shown in FIG. 2) that is pumped through the inlet opening 224 and into the interior cavity 322 of the diverter fitting 108 moves through the bypass opening 228 and through the inner opening 456 of the cavity 242 such that the coolant moves into the interior coolant passage 240 of the engine block 238.

Figure 6:
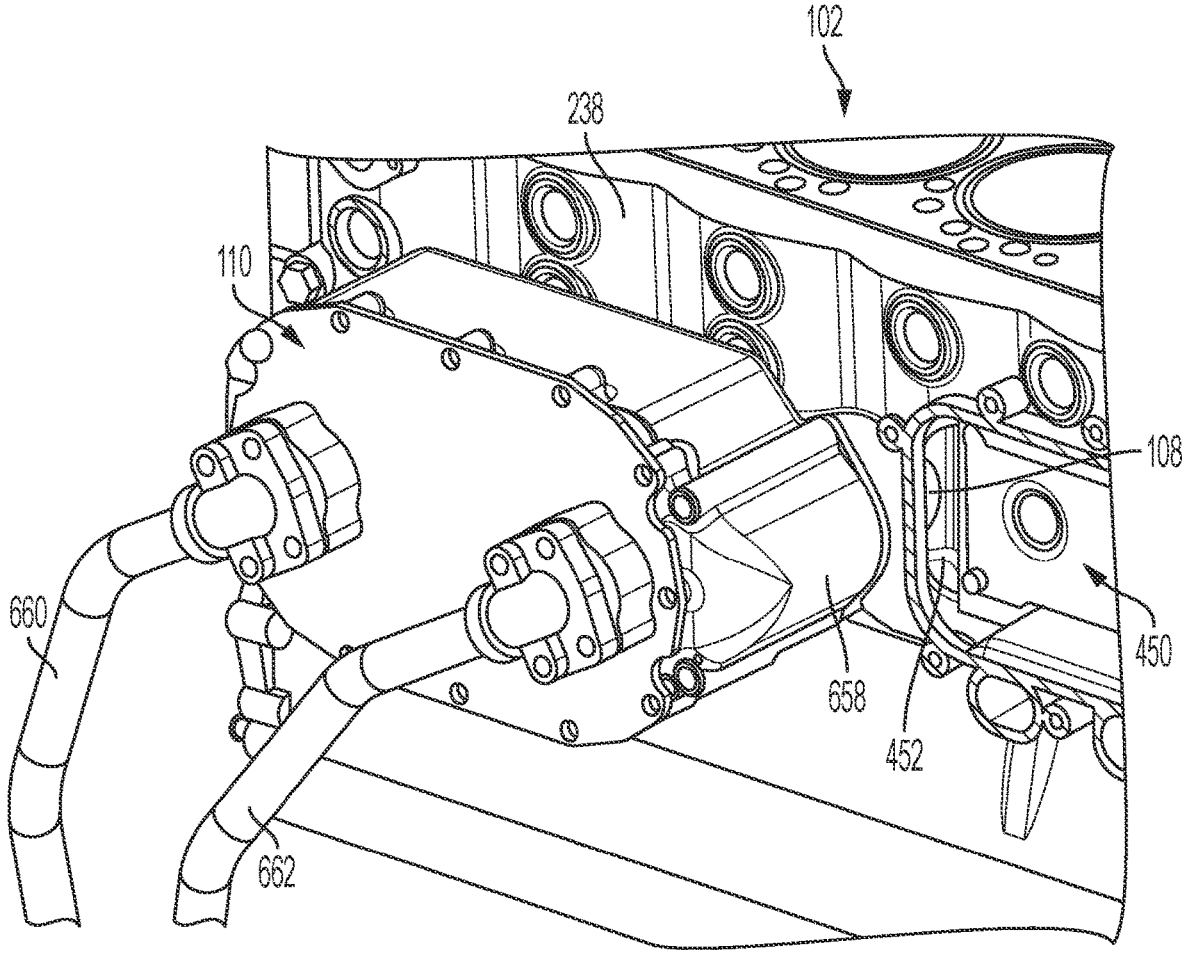
FIG. 6 is a perspective view of an exemplary embodiment of an external cooler attached to the engine block of FIG. 4.

Referring to FIGS. 4-6, the external cooler 110 is attached to the exterior surface of the engine block 238 such that a coolant inlet 658 of the external cooler 110 is in fluid communication with the outer opening 454 of the cavity 242, and such that an outlet (not shown) of the external cooler 110 is in fluid communication with the return opening 244 of the engine block 238. After a portion of the coolant (e.g., the portion 234 of coolant 232 shown in FIG. 2) moves through the external cooler 110, the coolant moves into the interior coolant passage 240 of the engine block 238 and mixes with a portion of the coolant (e.g., the portion 236 of coolant 232 shown in FIG. 2) that entered the engine block 238 through the bypass opening 228 of the diverter fitting 108. In various embodiments, the external cooler 110 includes an inlet conduit 660 and an outlet conduit 662, in which a heated fluid (e.g., hydraulic fluid) moves from the inlet conduit 660, through the external cooler 110, and exits through the outlet conduit 662. The heated fluid is cooled by the coolant moving through the external cooler. The external cooler 110 can be, for example, a transmission cooler, a brake cooler, or any other suitable type of external cooler that receives auxiliary cooling from the cooling system 100. In addition, the external cooler 110 can take any suitable form, such as, for example, the form of a 4-port style cooler, a shell and tube style cooler, a bathtub 2-port style cooler, or any other suitable type of cooler.

INDUSTRIAL APPLICABILITY

Current cooling systems that include an external cooler move the entire amount of coolant into the external cooler prior to the coolant entering the interior of the engine block. The external cooler 110 may be, for example, a transmission cooler or a brake cooler. Transmission and brake coolers, however, typically take the form of shell and tube style coolers, and shell and tube style coolers are typically too large to be able to fit on an engine, which means these coolers often need to be located elsewhere on a chassis of a machine. External coolers may, however, take the form of a 4-port style cooler. In these situations, the external cooler can be attached to the engine because a 4-port style cooler does not have the same size restrictions as the shell and tube style cooler.

In certain situations, it is advantageous to have a system in which the entire amount of coolant is not moved through the external cooler, but only a portion of the coolant is moved through the external cooler. For example, if a 4-port style external cooler is used and the entire amount of coolant is moved through the external cooler, the external cooler can be over-cooled and/or cause a pressure restriction for the pump that is pumping the coolant through the cooling system. In addition, moving the entire amount of coolant through the 4-port style cooler is a waste of power for the cooling system. In situations in which a shell and tube external cooler is used, the shell and tube cooler may not require the entire coolant for proper cooling, which means it is a waste of power to move the entire amount of coolant through the external cooler. While a 4-port external cooler and a shell and tube external cooler are described above, it should be understood that any type of external cooler could be used in situations in which it is not advantageous to move the entire amount of coolant through the external cooler.

The disclosed diverter fitting 108 is configured to be used in cooling systems for engines to limit the amount of coolant that moves into an external cooler. Referring to FIG. 2, when the diverter fitting 108 is positioned in the cavity 242 of the engine 102, coolant 232 pumped through the passage 248 moves into the inlet opening 224 of the diverter fitting 108 such that a first portion 234 of the coolant 232 moves through the outlet opening 226 and enters the external cooler 110, and a second portion 236 of the coolant 232 moves through the bypass opening 228 and enters the interior coolant passage 240 of the engine block 238. The first portion 234 of the coolant 232 enters the interior coolant passage 240 through the return opening 244 after moving through the external cooler 110 such that the first portion 234 and the second portion 236 of the coolant 232 mix in the interior coolant passage 240 of the engine block 238. The sizes of the outlet opening 226 and the bypass opening 228 dictate the amount of coolant that is sent to the external cooler 110. The diverter fitting 108 is configured to limit the amount of coolant that moves into the external cooler 110, thus preventing over-cooling of the external cooler, a pressure restriction for the water pump, and a waste of power of the cooling system.

In certain embodiments, the diverter fitting 108 is modular, which is advantageous because it allows the diverter fitting to be removed and replaced, if needed, as well as allowing the diverter fitting to be used on multiple engines. The replaceability of the diverter fitting 108 is advantageous because it allows diverter fittings 108 having different size outlet openings 226 and bypass openings 228 to be used depending on the situation in which the diverter fitting is being used. For example, if a situation requires more coolant to be supplied to the external cooler, a diverter fitting with a smaller bypass opening 228 can be used, which will allow more of the coolant to move through the outlet opening 226 and into the external cooler 110. In some situations, the cooling system 100 may not include an external cooler 110, and the diverter fitting 108 is not needed. In these situations, a modular diverter fitting 108 is advantageous because the diverter fitting can be removed or omitted, and the openings 242, 244 of the engine block 238 can be capped off. In addition, the passive design of the diverter fitting 108 is advantageous because it does not require active controlling of the diverter fitting 108 during use of the cooling system.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated. Accordingly, this disclosure includes all modification and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

ELEMENT LIST

Element Number Element Name
100 cooling system
102 engine
104 pump
106 oil cooler
108 diverter fitting
110 external cooler
112 thermostat housing
114 radiator
116 aftercooler
118 bypass line
130 thermostat
224 inlet opening of diverter fitting
226 outlet opening of diverter fitting
228 bypass opening of diverter fitting
232 coolant
234 first portion of coolant
236 second portion of coolant
238 engine block
240 interior coolant passage
242 cavity of engine block

244 return opening of engine block
246 exterior of engine block
248 coolant passage
320 base of diverter fitting
322 interior cavity of diverter fitting
370 first end of the base of the diverter fitting
372 second end of the base of the diverter fitting
374 cylindrical wall of the base of the diverter fitting
376 inner surface of the cylindrical wall
378 outer surface of the cylindrical wall
380 rib of the diverter fitting
450 oil cooler cavity of engine block
452 opening of cavity
454 outer opening of cavity
456 inner opening of cavity
658 coolant inlet of external cooler
660 inlet conduit of external cooler
662 outlet conduit of external cooler

The invention claimed is:

1. A passive diverter fitting for a cooling system of an engine, the engine comprising an engine block defining a block interior coolant passage, a cavity in fluid communication with the block interior coolant passage, and a return opening in fluid communication with the block interior coolant passage, the passive diverter fitting comprising:

a base defining an interior cavity of the passive diverter fitting, wherein the base is configured to be removably disposed in the cavity of the engine block such that an entirety of the passive diverter fitting fits within the cavity of the engine block;

an inlet opening extending through the base such that the inlet opening is in fluid communication with the interior cavity of the passive diverter fitting, wherein the inlet opening is positioned to receive coolant when the passive diverter fitting is disposed in the cavity of the engine block;

an outlet opening in fluid communication with the interior cavity of the passive diverter fitting, wherein the outlet opening is in fluid communication with an area exterior to the engine block when the passive diverter fitting is disposed in the cavity of the engine block; and a bypass opening extending through the base such that the bypass opening is in fluid communication with the interior cavity of the passive diverter fitting, wherein the bypass opening is in fluid communication with the block interior coolant passage when the passive diverter fitting is disposed in the cavity of the engine block, and wherein coolant received in the interior cavity of the passive diverter fitting via the inlet opening is split, such that a first portion of the coolant moves through the outlet opening and a second portion of the coolant moves through the bypass opening.

2. The passive diverter fitting according to claim 1, wherein the engine block comprises an oil cooler cavity on an exterior surface of the engine block, and wherein the inlet opening of the passive diverter fitting is in fluid communication with the oil cooler cavity when the passive diverter fitting is disposed in the cavity of the engine block.

3. The passive diverter fitting according to claim 1, wherein the base comprises at least one of iron or plastic.

4. The passive diverter fitting according to claim 1, wherein a first area defined by the bypass opening is between about 5% and about 25% of a second area defined by the outlet opening.

5. The passive diverter fitting according to claim 1, wherein the base comprises a cylindrical wall, an open first end, and a closed second end; and wherein the inlet opening and the bypass opening each extend through the cylindrical wall.

6. The passive diverter fitting according to claim 5, wherein the bypass opening is a drilled hole that extends through the cylindrical wall of the base.

7. The passive diverter fitting according to claim 6, wherein the inlet opening is positioned such that the inlet opening is between about 150 degrees and about 210 degrees away from the bypass opening with respect to the cylindrical wall of the base.

8. An engine block assembly, comprising:

an engine block defining a block interior coolant passage;

a cavity disposed in the engine block, the cavity comprising a receiving opening for receiving coolant, an inner opening that is in fluid communication with the block interior coolant passage, and an outer opening that is in fluid communication with an area exterior to the engine block; and a passive diverter fitting disposed in the cavity of the engine block, the passive diverter fitting comprising a base defining an interior cavity, an inlet opening, an outlet opening, and a bypass opening, wherein the inlet opening is in fluid communication with the receiving opening of the cavity of the engine block, wherein the outlet opening is in fluid communication with the outer opening of the cavity of the engine block, and wherein the bypass opening is in fluid communication with the inner opening of the cavity of the engine block, wherein the base comprises a cylindrical wall, an open first end, and a closed second end, wherein the inlet opening and the bypass opening each extend through the cylindrical wall, and wherein coolant received in the interior cavity of the passive diverter fitting via the inlet opening is split, such that a first portion of the coolant moves through the outlet opening and a second portion of the coolant moves through the bypass opening.

9. The engine block assembly according to claim 8, wherein an entirety of the passive diverter fitting is removably disposed in the cavity of the engine block.

10. The engine block assembly according to claim 8, wherein a first area defined by the bypass opening of the passive diverter fitting is between about 5% and about 25% of a second area defined by the outlet opening of the passive diverter fitting.

11. The engine block assembly according to claim 8, further comprising an oil cooler cavity, wherein the receiving opening of the cavity of the engine block is in fluid communication with the oil cooler cavity.

12. A cooling system, comprising:

a pump for pumping coolant through the cooling system;

an engine comprising an engine block, wherein the engine block comprises a block interior coolant passage, a cavity, and a return opening, wherein the cavity is in fluid communication with the block interior coolant passage and an area exterior to the engine block, wherein the return opening is in fluid communication with the block interior coolant passage and the area exterior to the engine block;

a passive diverter fitting disposed in its entirety in the cavity of the engine block, the passive diverter fitting comprising a base defining an interior cavity, an inlet opening, an outlet opening, and a bypass opening, wherein the inlet opening extends through the base and is in fluid communication with the pump, wherein the outlet opening is in fluid communication with the inlet opening, and wherein the bypass opening extends through the base and is in fluid communication with the inlet opening and the block interior coolant passage;

an external cooler having an inlet passage in fluid communication with the outlet opening of the passive diverter fitting and an outlet passage in fluid communication with the return opening of the engine block; and a radiator in fluid communication with the engine block and the pump;

wherein the pump is configured to pump coolant through the passive diverter fitting such that a first portion of the coolant moves through the outlet opening of the passive diverter fitting and into the external cooler and a second portion of the coolant moves through the bypass opening of the passive diverter fitting and into the block interior coolant passage.

13. The cooling system according to claim 12, further comprising an oil cooler disposed between the pump and the engine block.

14. The cooling system according to claim 12, further comprising:

a thermostat housing disposed between the engine block and the radiator, wherein the thermostat housing is in fluid communication with the engine block;

a thermostat disposed in the thermostat housing; and a bypass line disposed between the thermostat housing and the pump, wherein the bypass line is in fluid communication with the pump.

15. The cooling system according to claim 14, wherein the thermostat is configured to move between an open position and a closed position, wherein the thermostat housing is in fluid communication with the bypass line and not in fluid communication with the radiator when the thermostat is in the closed position, and wherein the thermostat housing is in fluid communication with the radiator and not in fluid communication with the bypass line when the thermostat is in the open position.

16. The cooling system according to claim 12, further comprising an aftercooler disposed between and in fluid communication with the pump and the engine block, wherein the pump is configured to pump a third portion of the coolant through the aftercooler, and wherein the third portion of the coolant moves into the engine block after moving through the aftercooler.

17. The cooling system according to claim 12, wherein a first area defined by the bypass opening of the passive diverter fitting is between about 5% and about 25% of a second area defined by the outlet opening of the passive diverter fitting.

18. The cooling system according to claim 12, wherein the external cooler is a 4-port style cooler.

19. The cooling system according to claim 12, wherein the base of the passive diverter fitting comprises a cylindrical wall, an open first end, and a closed second end; and wherein the inlet opening and the bypass opening each extend through the cylindrical wall.

20. The engine block assembly according to claim 8, further comprising:

a pump for pumping coolant through a cooling system;

an external cooler having an inlet passage in fluid communication with the outlet opening of the passive diverter fitting and an outlet passage in fluid communication with a return opening of the engine block; and a radiator in fluid communication with the engine block and the pump;

wherein the pump is configured to pump coolant through the passive diverter fitting such that the first portion of the coolant moves through the outlet opening of the passive diverter fitting and into the external cooler and the second portion of the coolant moves through the bypass opening of the passive diverter fitting and into the block interior coolant passage.

* * * * *